US008885859B2

(12) United States Patent
van Halteren

(10) Patent No.: US 8,885,859 B2
(45) Date of Patent: Nov. 11, 2014

(54) SEMI-PERMANENT HEARING AID

(75) Inventor: Aart Zeger van Halteren, Hobrede (NL)

(73) Assignee: Sonion Nederland BV, Amsterdam (NL)

( * ) Notice: Subject to any disclaimer, the term of this patent is extended or adjusted under 35 U.S.C. 154(b) by 393 days.

(21) Appl. No.: 13/184,348

(22) Filed: Jul. 15, 2011

(65) Prior Publication Data

US 2012/0014548 A1 Jan. 19, 2012

Related U.S. Application Data

(60) Provisional application No. 61/365,209, filed on Jul. 16, 2010.

(51) Int. Cl.
*H04R 25/00* (2006.01)

(52) U.S. Cl.
CPC ..... *H04R 25/602* (2013.01); *H04R 2225/31* (2013.01); *H04R 25/654* (2013.01); *H04R 2225/023* (2013.01); *H04R 25/604* (2013.01); *H04R 25/60* (2013.01)
USPC ..... 381/325; 381/322; 381/381; 181/135

(58) Field of Classification Search
USPC ..... 381/325, 381, 322; 181/135
See application file for complete search history.

(56) References Cited

U.S. PATENT DOCUMENTS

| | | | | |
|---|---|---|---|---|
| 4,870,689 | A * | 9/1989 | Weiss | 381/325 |
| 4,972,488 | A | 11/1990 | Weiss et al. | 381/68.6 |
| 4,987,597 | A | 1/1991 | Haertl | 381/69 |
| 6,105,713 | A | 8/2000 | Brimhall et al. | 181/135 |
| 6,546,108 | B1 | 4/2003 | Shennib et al. | 381/322 |
| 7,424,124 | B2 * | 9/2008 | Shennib et al. | 381/328 |
| 2007/0003086 | A1 | 1/2007 | Tilson et al. | 381/328 |

FOREIGN PATENT DOCUMENTS

| | | | | |
|---|---|---|---|---|
| EP | 0 310 866 | A1 | 4/1989 | H04R 25/02 |
| EP | 2 072 928 | A1 | 6/2009 | F24F 13/28 |
| WO | WO 96/21334 | A1 | 7/1996 | H04R 25/00 |
| WO | WO 2005/069683 | A1 | 7/2005 | H04R 25/02 |
| WO | WO 2005/076991 | A2 | 8/2005 | |

OTHER PUBLICATIONS

Extended Search Report for EP 11 17 4129 dated Apr. 18, 2012 (3 pages).
Partial Search Report for EP 11 17 4129 dated Oct. 18, 2011 (5 pages).

* cited by examiner

*Primary Examiner* — Davetta W Goins
*Assistant Examiner* — Amir Etesam
(74) *Attorney, Agent, or Firm* — Nixon Peabody LLP

(57) ABSTRACT

A semi-permanent hearing device is adapted to be inserted completely into the ear canal of a user. The semi-permanent hearing device comprises a first part and a second part each of which comprises at least one of the following electrical components: a microphone, a sound processing unit, a receiver and a battery. The first part and the second part are detachably connected to each other. In an alternative aspect of the invention, a hearing device comprises a microphone and a wax filter arrangement arranged to cover at least one audio canal through which sound propagates from a position outside the hearing aid and into the microphone. The wax filter arrangement comprises a wax filter and the wax filter arrangement is adapted to allow different parts of the wax filter to cover the at least one audio canal at different points in time.

14 Claims, 6 Drawing Sheets

SEMI-PERMANENT HEARING AID

REFERENCE TO RELATED APPLICATIONS

This application claims the benefit of U.S. Provisional Patent Application Ser. No. 61/365,209, filed Jul. 16, 2010, and titled "Semi-Permanent Hearing Aid," which is incorporated herein in its entirety.

FIELD OF THE INVENTION

The present invention relates to a semi-permanent hearing device adapted to be inserted completely into the ear canal of a user.

A major factor driving the development of hearing aids is the desire for small hearing aids that can be worn inconspicuously which addresses the cosmetic impediments associated with hearing aids. Therefore, there is a trend of continuous miniaturization which e.g. triggered the development of Completely-in-Canal hearing aids. The position of a hearing aid in the ear canal implies a number of issues such as an increased risk of ear wax hampering the functioning of components e.g. the occlusion of sound ports thereof. To address this daily cleaning is advised by manufactures requiring frequent removal and replacement of the CIC-Hearing aid. Semi-permanent hearing aids have been developed to alleviate the problems related to CIC-hearing aids as explained e.g. in U.S. Pat. No. 7,424,124. They are referred to as semi-permanent as they can be worn continuously without the necessity of taking them out until the battery becomes depleted. The semi-permanent hearing aid disclosed in U.S. Pat. No. 7,424,124 is designed for deep fitting in the ear canal such that only a sealing retainer containing the receiver touches the ear canal. Moreover, contact is only made in the bony region thereof, while the battery and microphone are located in the cartilaginous region of the ear canal but not in contact with the walls thereof. However, as the production of ear wax mainly occurs in this cartilaginous region, the microphone is still prone to occlusion by ear wax. In addition, the confined space deeply in the ear canal restricts the size of the battery and hence limits the capacity for energy storage; the smaller the battery, the shorter the life time. Accordingly, the energy consumption of the hearing aid is reduced to a minimum level by applying very basic low-energy consumption parts with reduced functionality. This has lead to so-called disposable hearing aids, as their economic life time is severely shortened compared to conventional hearing aids. Their economic life time expires either with the moment of depletion of the battery or with the moment the components are occluded by ear wax and physiological debris or both.

SUMMARY OF THE INVENTION

A first aspect the present invention relates to a semi-permanent hearing device adapted to be inserted completely into the ear canal of a user. The semi-permanent hearing device comprises a first part and a second part, each of which comprises at least one of the following components: a microphone, a sound processing unit, a receiver and a battery. The first part and the second part of the semi-permanent hearing device are detachably connected to each other, so as to allow the first part to be disposable, while the second part is reused with a new first part.

One advantage of providing the semi-permanent hearing device with a first and a second part is that the electrical components of one of the two parts may be reused while the electrical components of the other of the two parts may be disposable. As an example one of the two parts may comprise the battery, while the other of the two parts comprises the sound processing unit and/or the receiver. Thus, instead of disposing the entire hearing aid when the battery is discharged, that part which contains the battery may be replaced while the other part containing the sound processing unit and/or the receiver, may be reused. In embodiments in which the sound processing unit is reused, it becomes economically feasible to use a more expensive sound processing unit, which is often more sophisticated. Accordingly, the present invention provides for use of a sophisticated sound processing unit while at the same time allowing the battery to be disposed.

In the context of the present invention, the term "semi-permanent hearing aid/device" shall be understood as a hearing device that is shaped such that the entire hearing device is suitable for deep insertion into the ear canal of the user, i.e. past the orifice/aperture of the ear canal. Such semi-permanent hearing devices are suitable for long-term use in the ear canal. As an example, the hearing device may be installed into the ear for the entire life time of a battery in the semi-permanent hearing device. In one embodiment, the semi-permanent hearing device is preferably inserted deep enough into the ear canal, so that the semi-permanent hearing device is not visible from a position outside the ear during use. In one embodiment, the semi-permanent hearing device will typically be inserted into the ear canal by a third person e.g. a doctor or a hearing aid specialist, in order to ensure that the semi-permanent hearing device is inserted into the correct position. However, in some embodiments, the user may insert the hearing device without the aid of a doctor or a hearing specialist.

In the context of the present invention, the term "inserted completely into the ear canal" shall be understood such that the hearing device is inserted past the aperture of the ear canal, i.e. such that no part of the hearing device extends out of the aperture of the audio canal. In one embodiment of the present invention, at least a part of the hearing aid is inserted into the area of the temporal bone, e.g. such that at least a part of the hearing aid is positioned medially relative to at least a part of the temporal bone. Accordingly, in one embodiment, the most lateral part of the temporal bone is positioned laterally relative to the most medial part of the hearing device. In one embodiment, at least a part of the hearing aid is encircled by at least a part of the temporal bone.

It will be appreciated that in the ear canal, very little or even substantially no cerumen is produced in the area of the temporal bone, whereas most of the cerumen is produced in the area of the cartilaginous region positioned laterally relative to the temporal bone. In one embodiment, the entire semi-permanent hearing device is positioned medially relative to the most medial part of the cartilaginous region in the ear. In one embodiment, one part of the hearing device is encircled by the temporal bone, while another part of the hearing device is encircled by the cartilaginous region of the ear.

In the context of the present invention, the "lateral direction" shall be understood as the direction extending away from the "Medial Saggital plane". The "Medial Saggital plane" being the vertical plane extending through the midline/center of gravity of the body (positioned in the "anatomical position", i.e. standing upright with the hand and arms extending downwards and with the palms facing forward) and dividing the body into right and left halves. Similarly the term "medial direction" shall be understood as the direction towards the "Medial Saggital plane".

It will be appreciated that the term "ear canal" shall be understood as the external auditory meatus, i.e., the tube extending from the middle ear to the outer ear. In other words, from the pinna to the ear drum. The ear canal is generally divided into two parts. A cartilaginous part formed by the outer most lateral third of ear canal which contains cartilage, and a bony part formed by the inner most medial two thirds, which are closest to the ear drum.

The semi-permanent hearing device comprises a first part and a second part, each of which comprises one or more of the following electrical components: a microphone, a sound processing unit, a receiver and a battery. The sound processing unit may comprise an amplifier and/or a signal processing unit, such as a Digital Signal Processing unit (a DSP unit). It will be appreciated that the hearing device may comprise at least one microphone, such as one, such as two, such as three, such as four, such as five, etc. Moreover, it will be appreciated that the hearing apparatus may comprise at least one battery, such as one, such as two, such as three. The battery may be a non-rechargeable battery or a rechargeable battery. In the case of a rechargeable battery, terminals may be provided on a surface of the device, which terminals are used to electrically connect an external battery recharger device to the rechargeable battery. Additionally, the hearing device may comprise one or more sound processing units, such as one, two, three etc. In one embodiment, the hearing device comprises at least one receiver, such as one, such as two, such as three, such as four, such as five.

In one embodiment, the first part comprises the microphone. In another embodiment, the first part comprises the microphone and the battery. In a third embodiment, the first part comprises the microphone, the battery and the sound processing unit or the receiver.

In one embodiment, the second part comprises the receiver. In a second embodiment, the second part comprises the receiver and the sound processing unit. In a third embodiment, the second part additionally comprises either the battery or the microphone.

The first and the second parts are detachably connected to each other. In one embodiment, the first and the second parts are connected to each other by means of a threaded connection. Alternatively, or as a supplement, the two parts are fastened to each other by means of a spring biased lock connection comprising a leaf spring which forces a protrusion (of one of the first and second parts) into engagement with an indentation (of the other of the first and the second parts) so as to lock the first and the second parts to each other.

In one embodiment, the first part forms a lateral part and the second part forms a medial part. In another embodiment, the first part forms the medial part while the second part forms the lateral part. In one embodiment, the lateral part comprises the battery and the microphone. This provides the advantage that the most lateral part comprises the parts which are disposed once the battery is discharge. Accordingly, this embodiment provides the advantage that the medial part may remain inside the ear of the user, while the lateral part is replaced by a new lateral part comprising a new and fully charged battery.

In one embodiment, the lateral part and the medial part comprises one or more electrical connectors which, when the lateral part is attached to the medical part, electrically connects the electrical components of the lateral part to the electrical components of the medial part. When the first and the second parts are detachably fastened to each other, electrical connectors may be electrically connected to each other, e.g. by means of electrical contacts which abut each other.

In one embodiment, the battery is positioned laterally relative to the microphone when the hearing device is positioned in the ear canal. As an example, a center of gravity of the battery may be positioned laterally relative to a center of gravity of the microphone, when the hearing device is positioned in the ear canal. Alternatively, or as a supplement, the most medial part of the battery may be positioned laterally relative to the most lateral part of the microphone, when the hearing device is positioned in the ear canal. By providing the battery laterally relatively to the microphone, the battery may serve as a barrier for flow of cerumen into the area of the microphone. It will be appreciated that when the microphone is blocked by cerumen, it is difficult, if not impossible, for sound to propagate to the microphone. This causes the hearing aid to malfunction, as the sound which needs to be amplified cannot be detected by the microphone. A filter may be provided between the microphone and the battery so as to prevent cerumen from being brought into contact with the microphone. Alternatively, or as a supplement, a filter may be provided in front of the battery, i.e. laterally relative to both the microphone and the battery, when the hearing device is positioned in the ear of the user.

Moreover, the microphone may be completely covered by the battery, when seen from a position which is lateral relative to the hearing aid and towards a middle ear of the user, and when the hearing device is positioned in the ear canal. The term "completely covered" shall be understood to mean that when the hearing device is positioned in the ear, a projection of the battery onto the Medial Saggital plane is encirculated completely by a projection of the microphone onto the Medial Saggital plane. Moreover, it will be appreciated that the battery does not cover the microphone in such a way that sound is prevented from propagating to the microphone.

As mentioned above, the semi-permanent hearing device may comprise a wax filter arrangement according to the second aspect of the invention.

As an example, the semi-permanent hearing device according to the first aspect of the invention may comprise a wax filter arrangement arranged to cover at least one audio canal through which sound propagates from a position outside the hearing device and into the microphone. The wax filter arrangement may comprise a wax filter which is adapted to allow different parts of the filter to cover the at least one audio canal at different points in time.

As another example, the wax filter arrangement comprises one or more wax filters. The one or more wax filters define at least two wax filter zones, such as two wax filter zones, such as three wax filter zones, such as four wax filter zones, such as five wax filter zones, such as six wax filter zones, such as seven wax filter zones, such as eight wax filter zone, etc. The one or more wax filters may be movable relative to the hearing device such that different wax filter zones can cover the audio canal at different points in time. As yet another example, the wax filter arrangement comprises a wax filter which is rotatable about an axis, and wherein the wax filter defines one or more wax filter zones which are arranged such that when the wax filter is rotated, a first wax filter zone covers the audio canal at a first point in time, and a second wax filter zone covers the audio canal at a second point in time.

It will be appreciated that the wax filter arrangement according to the first aspect of the invention may comprise any combination of features and elements of the wax filter arrangement according to the second aspect of the invention.

In a second aspect, the present invention relates to a hearing device comprising a microphone and a wax filter arrangement arranged to cover at least one audio canal through which sound propagates from a position outside the hearing aid and into the microphone. The wax filter arrangement comprises a wax filter and wherein the wax filter arrangement is adapted to allow different parts of the wax filter to cover the at least one audio canal at different points in time.

By allowing different parts of the filter to be used at different points in time, it is possible to switch from a used and contaminated filter to an unused (and thus uncontaminated) filter after a first part of the filter has been contaminated by ear wax. In one embodiment, the wax filter arrangement comprises one or more wax filters. The one or more wax filters define at least two wax filter zones. The one or more wax filters may be movable relative to the hearing device such that different wax filter zones can cover the audio canal at different points in time. In one embodiment, the one or more wax filters are slidable relative to the hearing aid such that they may be slidingly moved between a first position in which they are protected from contamination of ear wax and a second position in which they serve as a filter covering the audio/sound canal of the hearing aid and, thus, serve as a filter for protecting the microphone.

In one embodiment, the wax filter arrangement comprises a wax filter which is rotatable about an axis, and wherein the wax filter defines one or more wax filter zones that are arranged such that when the wax filter is rotated, a first wax filter zone covers the audio canal at a first point in time, and a second wax filter zone covers the audio canal at a second point in time.

BRIEF DESCRIPTION OF THE FIGURES

The invention will now be described in further detail with reference to the drawings, in which.

DETAILED DESCRIPTION OF THE FIGURES

Figure 1:
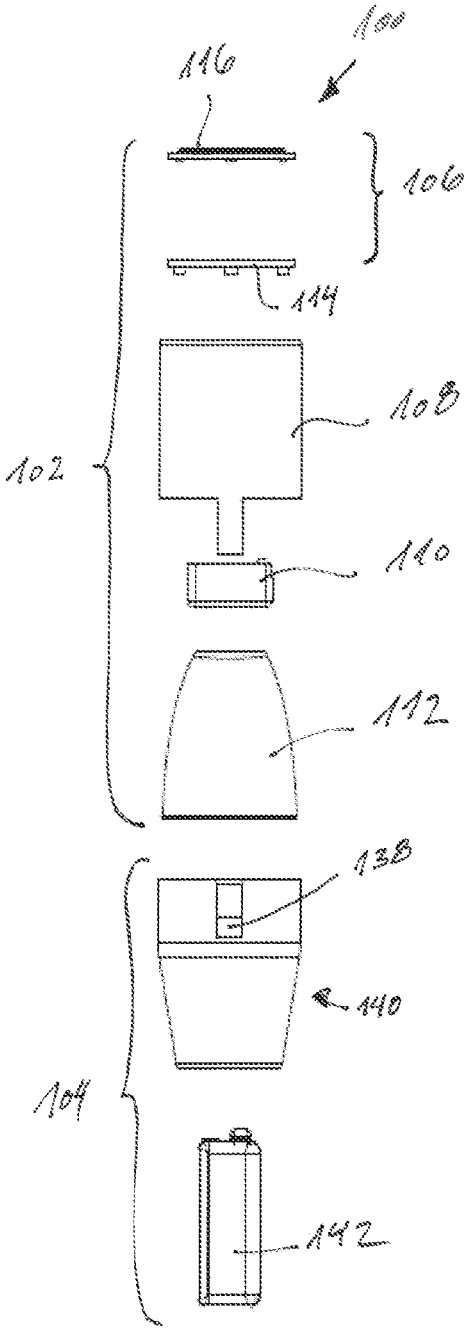
FIG. 1 illustrates a two dimensional exploded view of the semi-permanent hearing device.

FIG. 1 illustrates a semi-permanent hearing device 100 comprising a first part 102 and a second part 104. The semi-permanent hearing device 100 is adapted to be inserted completely into the ear canal (see FIG. 9) such that no part of the semi-permanent hearing device 100 extends out of the orifice/aperture of the ear canal (see FIG. 9). When the semi-permanent hearing device 100 is inserted into the ear canal, the first part 102 is positioned laterally relative to the second part 104. Accordingly, the second part 104 is positioned closer to the ear drum than the first part 102. The first part 102 comprises a wax filter arrangement 106, a first housing part 108, a microphone unit 110, and a battery unit 112. The wax filter arrangement 106 comprises a filter unit 114 and a cover plate 116.

Figure 4:
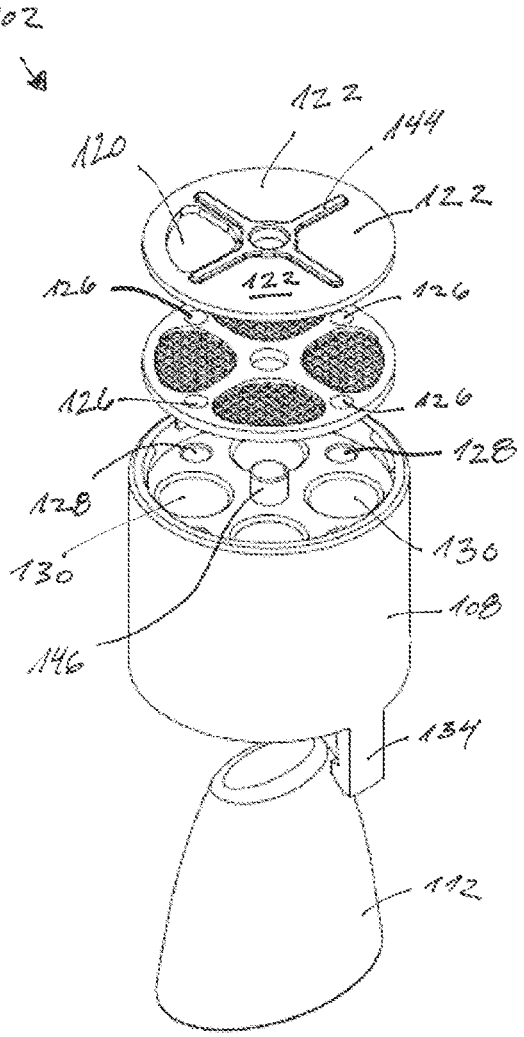
FIG. 4 illustrates a three dimensional exploded view of the first/lateral part.

The filter unit 114 defines a first, second, third and fourth filter zone 118', 118", 118''', 118'''' (see FIGS. 4 and 6) which can be used at different points in time, one each at the time. In order to ensure that only one filter zone 118 can be used at the time, the cover plate 116 defines an opening 120, and three cover zones 122 as seen in FIG. 4. When the cover plate 116 is positioned on top of the filter unit 114, three of the filter zones 118 are covered by a cover zone 122 of the cover plate 116, while the fourth of the filter zones 118 is uncovered as the opening 120 of the cover plate 116 is positioned on top of this filter zone 118. Accordingly, sound may propagate through that of the filter zones 118 which are provided below the opening 120, whereas the sound is prevented from propagating through the remaining three filter zones 118, as they are coved by the three cover zones 122.

Figure 5:
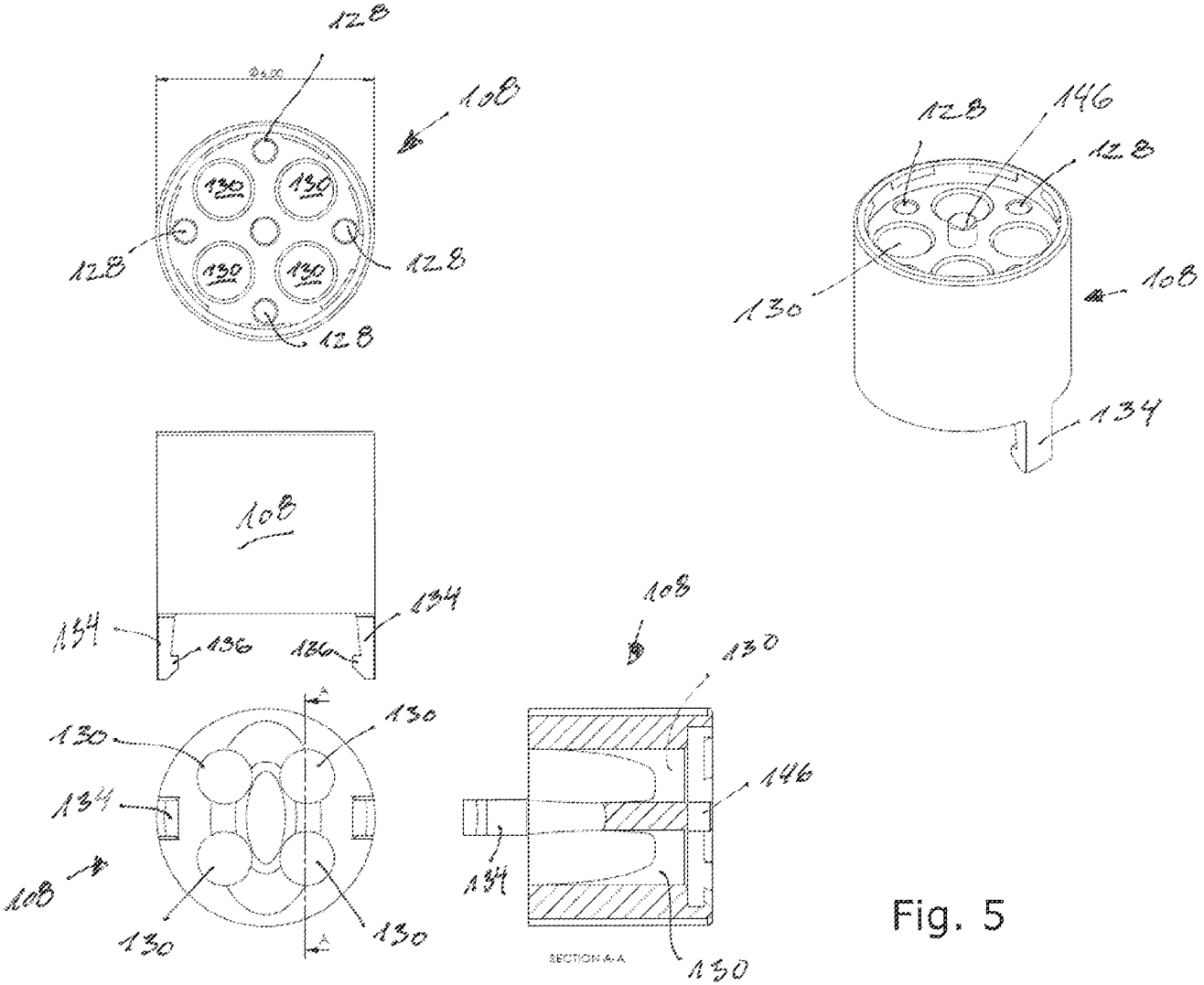
FIG. 5 illustrates different views of the first housing part.
Figure 6:
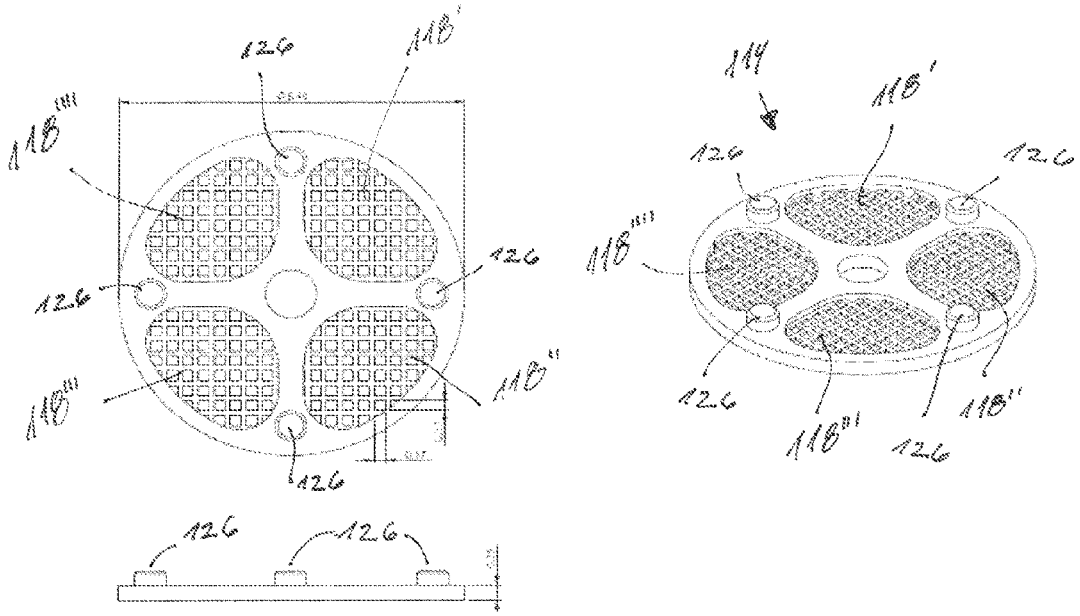
FIG. 6 illustrates different views of the rotatable wax filter.

In order to allow the cover plate 116 to be retained relative to the filter unit 114, the cover plate 116 defines four protrusions 124 (see FIG. 7), which are adapted to engage corresponding indentations 126 of the filter unit 114, see FIGS. 4 and 6. Similarly the filter unit 114 defines four protrusions 126 which are adapted to engage corresponding indentations 128 of the first housing part 108, whereby the filter unit 114 may be retained relative to the first housing part 108. By retaining the filter unit 114 relative to the first housing part 108, it is ensured that each of the four audio canals 130 is covered by one of the filter zones 117. The audio canals 130 are described in further detail below in relation to FIG. 5.

Referring back to FIGS. 1 and 2, the microphone unit 110 comprises one or more microphones (not visible). In one embodiment, the microphone unit 110 comprises four microphones one for each of the audio canals 130, in another embodiment, the microphone unit 110 comprises one single microphone. When the semi-permanent hearing device 100 is provided inside the ear of the user, the microphone unit 110 is positioned laterally relative to the battery unit 112. However, it will be appreciated that in other embodiments, the battery unit 112 is positioned laterally relative to the microphone unit 110.

Figure 2:
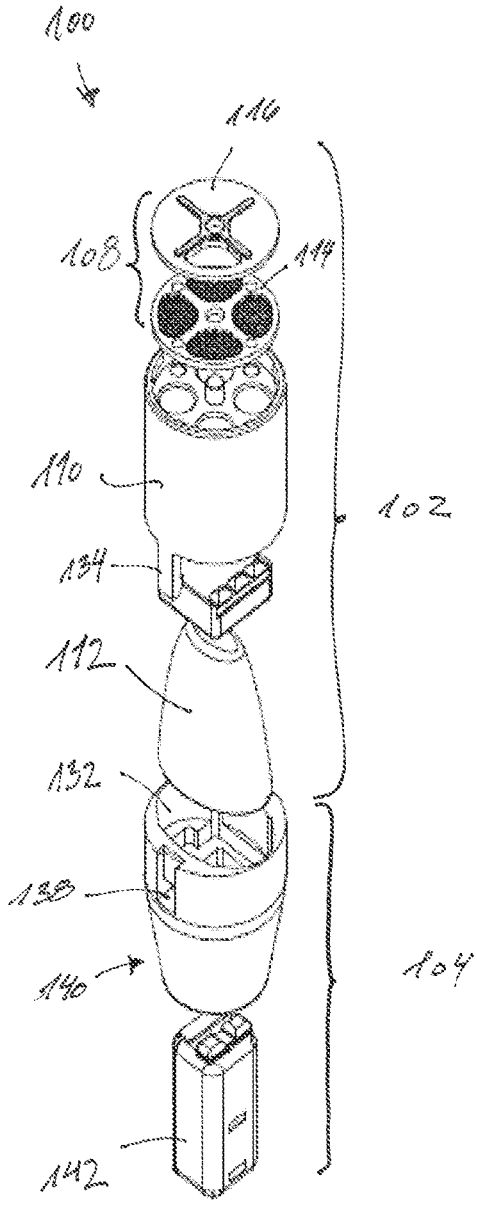
FIG. 2 illustrates a three dimensional exploded view of the semi-permanent hearing device.
Figure 3:
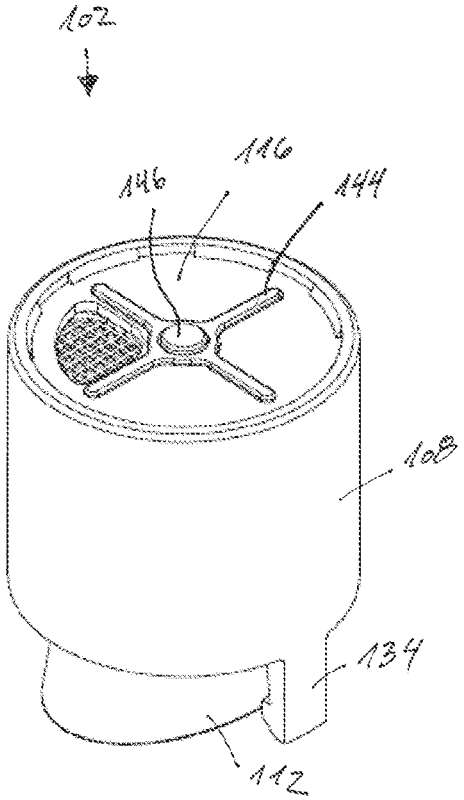
FIG. 3 illustrates a three dimensional view of the first/lateral part.

When the first part 102 and the second part 104 are fastened to each other, the battery unit 112 may be received in the second part 104, such as in a cavity 132 thereof as shown in FIG. 2. The first part 102 and the second part 104 are retained relative to each other by means of a spring biased lock 134 defining a leaf spring extending from first housing part 108 and defining a protrusion 136 (see FIG. 5) at its end. The protrusion 136 is adapted to engage a corresponding indentation 138 of the second housing part 140 whereby the first part and the second part are releasably locked to each other.

The second housing part 140 is adapted to receive a signal processing unit 142, which also comprises the receivers of the semi-permanent hearing device 100. The receivers are not visible in the drawings.

Figure 7:
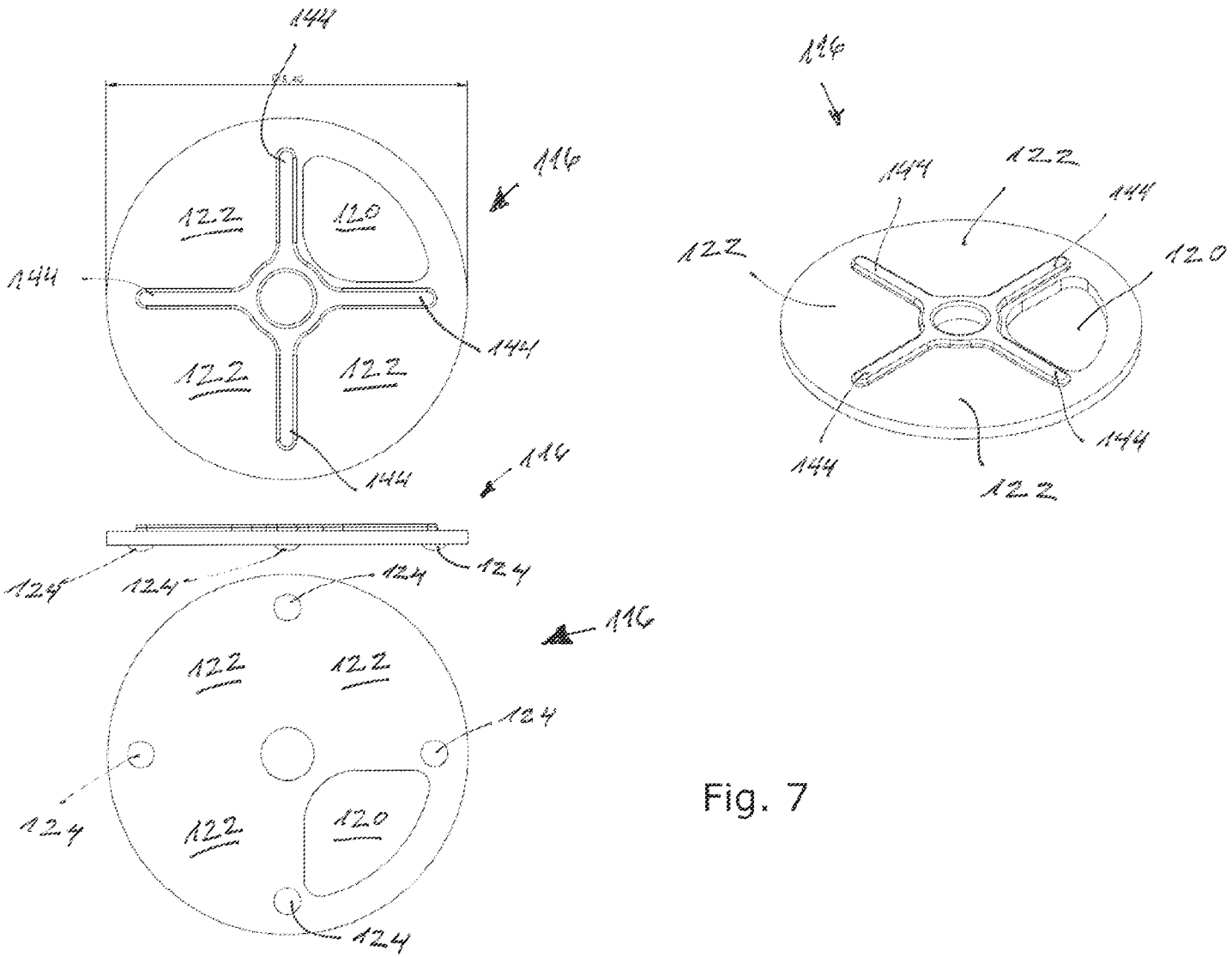
FIG. 7 illustrates different views of the rotatable cover plate.

In order to allow a user, a doctor, or a hearing aid specialist to change a used filter that is contaminated with cerumen, to an unused and uncontaminated filter, the cover plate 116 defines four ridges 144 which may be used to rotate the cover plate 116 about the cylinder 146 of the first housing part 108, which receives the cover plate 116 and the filter unit 114 and shown in FIGS. 2 and 7.

Figure 8:
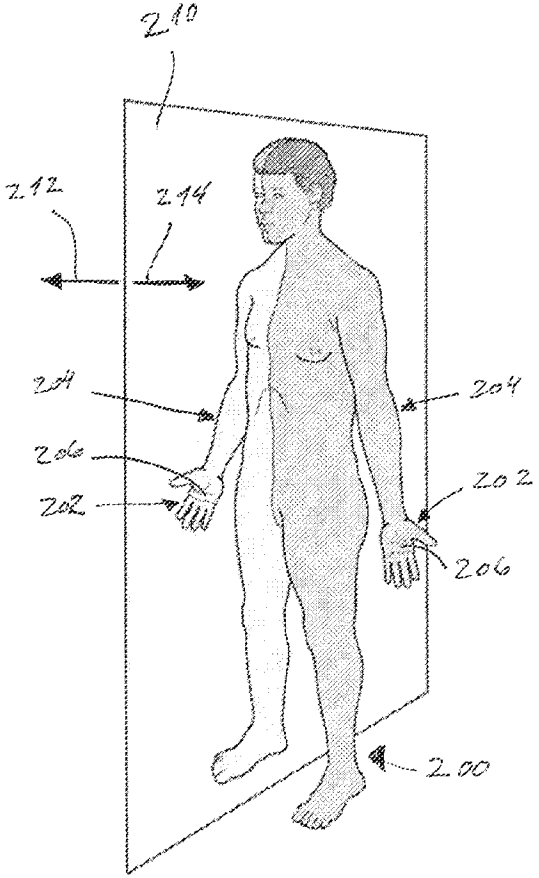
FIG. 8 illustrates the "Medial Saggital plane" of a person in the "anatomical position.

FIG. 8 illustrates a person with a body 200 positioned in the "anatomical position", i.e. standing upright with the hands 202 and arms 204 extending downwards and with the palms 206 facing forward. Moreover, FIG. 8 illustrates the Medial Saggital plane 210 i.e. the vertical plane 210 extending through the midline/center of gravity of the body 200 and dividing the body 200 into a right and left halves, indicated by arrows 212 and 214, respectively. The medial direction is the direction towards the Medial Saggital plane 210, from either of the right half 212 and the left half 214. The lateral direction is the direction extending away from the "Medial Saggital plane". Accordingly, both arrows 212, 214 extend in the lateral direction.

Figure 9:
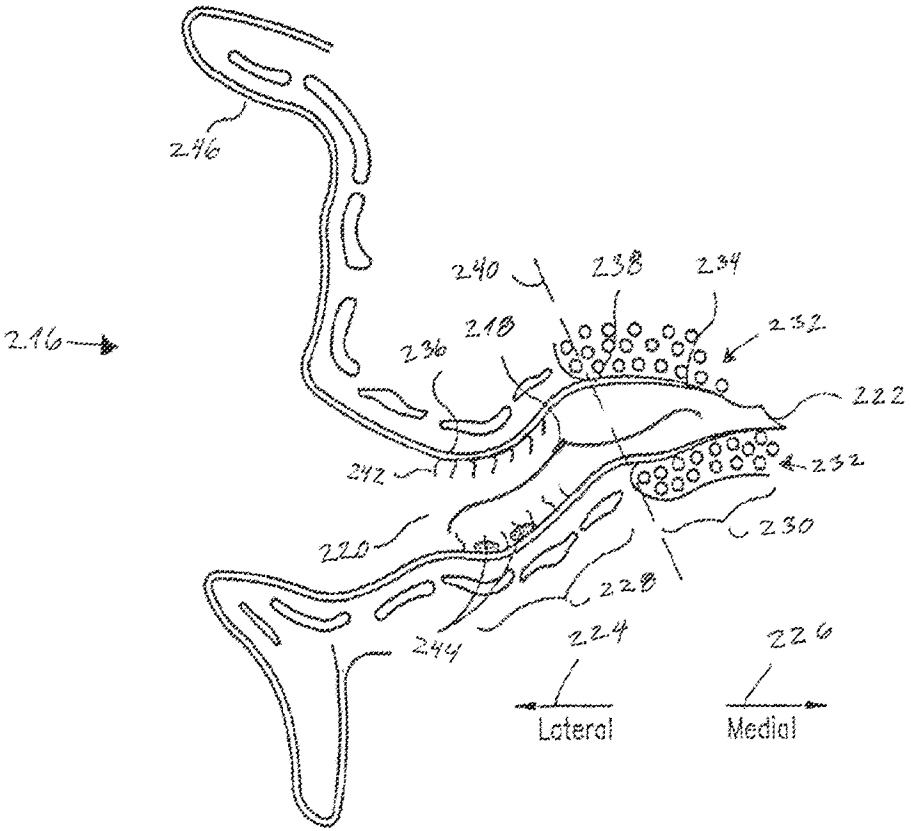
" and FIG. 9 illustrates the anatomy of the outer ear.

FIG. 9 illustrates the anatomy of an ear 216, comprising an ear canal 218. The distance from the canal aperture 220 to the tympanic membrane 222 (the ear drum) is typically in the range from 20-30 mm. The lateral direction of the ear is indicated by arrow 224 and the medial direction is indicated by arrow 226. In the lateral part of the ear, a cartilaginous region 228 is formed. The cartilaginous region 228 is relatively soft due to the underlying cartilaginous tissue. The cartilaginous region 228 moves in response to the motion of the jaw, e.g. during chewing and talking. Cerumen production and hair growth occur primarily in the lateral end of the ear canal 218. Moreover, the ear canal 218 defines a medial part 230, which relative to the cartilaginous region 228 is rigid due to the underlying temporal bone 232. The skin 234 in the bony region 230 is thin (relative to the skin 236 in the cartilaginous region 228) and is sensitive to touch or pressure. A characteristic bend 238 roughly occurring at the bony-cartilaginous junction 240 separates the cartilaginous and bony regions 228 and 230, respectively. The magnitude of this bend varies significantly among individuals. FIG. 9 also illustrates hair 242, cerumen 244 and pinna 246.

The invention claimed is:

1. A hearing device, comprising:

a microphone; and a wax filter arrangement arranged to cover at least one audio canal through which sound propagates from a position outside the hearing aid and into the microphone, wherein the wax filter arrangement comprises one or more wax filters, the one or more wax filters defining at least two wax filter zones, wherein the one or more wax filters are movable relative to the hearing device such that different wax filter zones can cover the audio canal at different points in time.

2. A hearing device according to claim 1, wherein the one or more wax filters is rotatable about an axis, such that when the wax filter is rotated, a first wax filter zone covers the audio canal at a first point in time, and a second wax filter zone covers the audio canal at a second point in time.

3. A hearing device, comprising:

a microphone; and a wax filter arrangement arranged to cover at least one audio canal through which sound propagates from a position outside the hearing aid and into the microphone, wherein the wax filter arrangement comprises a wax filter which is rotatable about an axis, and wherein the wax filter defines one or more wax filter zones which are arranged such that when the wax filter is rotated, a first wax filter zone covers the audio canal at a first point in time, and a second wax filter zone covers the audio canal at a second point in time.

4. A hearing device, comprising:

a microphone; and a wax filter arrangement adjacent to the microphone, the wax filter arrangement covering at least one audio canal through which sound propagates into the microphone, the wax filter arrangement having a plurality of wax filter zones and being adapted to allow different ones of the plurality of filter zones to provide a filtering function for the at least one audio canal at different points in time, wherein at least one of the wax filter arrangement and a structure defining the at least one audio canal are moveable relative to each other so as to permit movement of the at least one audio canal over the different ones of the plurality of filter zones.

5. A hearing device, comprising:

a microphone; and a wax filter arrangement arranged to cover at least one audio canal adapted to guide sound from outside the hearing device to the microphone, the wax filter arrangement comprising a wax filter having one or more wax filter zones, each wax filter zone being movable relative to the hearing device between a first position and a second position, the first position protecting the wax filter zone from contamination, the second position exposing the wax filter zone to the audio canal.

6. A hearing device according to claim 5, wherein one of the one or more wax filter zones is rotatable about an axis, and wherein the one or more wax filter zones are arranged such that when the wax filter is rotated, a first wax filter zone is rotated from the first position to the second position.

7. A hearing device according to claim 5, wherein the hearing device is adapted to be inserted completely into the ear canal of a user and comprises a sound processing unit, a receiver and a battery, the hearing device further comprising a first part and a second part detachably connectable to each other, the first part being disposable, while the second part may be reused with a new first part.

8. A hearing device according to claim 7, wherein the first part comprises the battery and the microphone.

9. A hearing device according to claim 7, wherein the first part and the second part include one or more electrical connectors which, when the first part is attached to the second part, electrically connects electrical components of the first part to electrical components of the second part.

10. A hearing device according to claim 8, wherein the microphone is positioned closer than the battery to the second part.

11. A hearing device according to claim 7, wherein a center of gravity of the microphone is positioned closer than a center of gravity of the battery to the second device.

12. A hearing device according to claim 7, wherein a closest part of the battery is a part of the battery positioned the closest to the second part, the closest part of the battery is positioned farther from the second part than a farthest part of the microphone, and the farthest part is a part of the microphone positioned the farthest from the second part.

13. A hearing device according to claim 5, further comprising:

a disposable first part including at least one of the group consisting of the microphone, a sound processing unit, a receiver and a battery; and a reusable second part including at least one of the group consisting of the microphone, a sound processing unit, a receiver and a battery, the reusable second part being sequentially detachably connectable to the disposable first part and a new disposable first part.

14. A hearing device according to claim 5, further comprising a cover plate, and wherein the filter arrangement comprises four filter zones, the cover plate comprising three cover zones and an opening positioned at the audio canal, wherein the cover plate is positioned so that the three cover zones cover three of the four filter zones and a fourth one of the filter zones is provided at the opening.

* * * * *